US005123720A

United States Patent [19]

Blomster et al.

[11] Patent Number: 5,123,720

[45] Date of Patent: Jun. 23, 1992

[54] BOTTLED WATER DISPENSER STAND

[76] Inventors: Wilbur C. Blomster, 22886 Roebuck, El Toro, Calif. 92630; David Ferguson, 8692 Kent Cir., Huntington Beach, Calif. 92647

[21] Appl. No.: 682,134

[22] Filed: Apr. 8, 1991

[51] Int. Cl.[5] ..... A47B 88/00

[52] U.S. Cl. ..... 312/283; 312/228; 312/257.1

[58] Field of Search ..... 312/257.1, 263, 140, 312/228; 403/401, 402

[56] References Cited

U.S. PATENT DOCUMENTS

| | | | |
|---|---|---|---|
| 1,129,040 | 2/1915 | McClure | 312/263 X |
| 1,156,443 | 10/1915 | Stevens | 312/263 X |
| 3,190,710 | 6/1965 | Freeman | 312/263 |
| 3,297,384 | 1/1967 | Buice | 312/263 |
| 4,295,693 | 10/1981 | Viklund | 312/263 X |
| 4,621,877 | 11/1986 | Boudreau et al. | 312/257.1 |
| 4,786,122 | 11/1988 | Nichoalds | 312/257.1 |

*Primary Examiner*—Joseph Falk
*Attorney, Agent, or Firm*—G. Donald Weber, Jr.

[57] ABSTRACT

A stand specifically adapted to support a liquid container such as a water bottle or the like is provided. The stand is fabricated of a strong but lightweight plastic-type material which is durable, yet relatively inexpensive to fabricate and maintain. A substantially modular unit is provided which is inexpensive as well as lightweight.

11 Claims, 1 Drawing Sheet

BOTTLED WATER DISPENSER STAND

BACKGROUND OF THE INVENTION

1. Field of the Invention

This invention is directed to water dispenser units, in general, and to an improved stand or cabinet associated therewith, in particular.

2. Prior Art

There are many reasons for using bottled water or other similar materials. Bottled water is a widely used product in areas where water is not readily available; where the water supplied is unpotable or otherwise untasteful; where medical reasons dictate; and so forth. The use of such water dispensers is widespread and is not a new or unique phenomenon.

In addition, the supports, stands and/or cabinets which are used with such bottled water dispensers or the like are legion. These stands include decorative units which include flower pots and the like. Alternatively, the stands are totally and completely functional units which have little or no decorative value, per se.

In addition, these water dispensing systems include appropriate devices or systems for causing the water to be made hot or cold. These factors are controlled by refrigeration and/or heat exchanger units.

However, the "typical" type of cabinet is relatively expensive to manufacture and maintain. Typically, these cabinets are made of metal and are frequently damaged by being dented or bent by careless installers, maintenance personnel or the like. In addition, the metal units are usually painted with a spray or anodized paint. This paint is fairly easily chipped which causes the cabinet to have an undesirable appearance.

In addition, these units are typically very heavy and difficult to move from one location to another as well as being expensive to ship from the manufacturer to the distributor and to the consumer.

Likewise, the standard or typical unit is quite expensive to manufacture. Consequently, either the bottled water distributor must have an enormous capital investment in cabinets which are either loaned or rented to customers; or the cost to the ultimate consumer is increased because of the amortization of the expensive cabinets in one form or another.

A few cabinets have been made of plastic, fiberboard or other less expensive materials. However, for the most part these "inexpensive" cabinets have turned out to be less than fully satisfactory because of short lifetimes, difficult assembly or manufacturing, and/or extensive replacement requirements.

PRIOR ART STATEMENT

Some pertinent prior art is listed herewith in numerical order. The order of the listing has no significance.

U.S. Pat. No. 3,698,603; WATER-DISTRIBUTING SYSTEM FOR HOT AND COLD DRINKING WATER DISPENSER; R. J. Radcliffe. This patent is directed to an inverted bottle-type drinking water dispenser having a pair of vertically spaced water cooling and heating receptacles mounted therein to provide hot or cold water.

U.S. Pat. No. 3,811,294; COOLER FOR FAUCET-EQUIPPED BEVERAGE CONTAINERS; W. Taylor. This patent is directed to a beverage dispenser which includes a refrigerated cooler in a rigid or semi-rigid, faucet-equipped container.

U.S. Pat. No. 4,061,184; HEAT EXCHANGER FOR A REFRIGERATED WATER COOLER; R. J. Radcliffe. This patent is directed to a heat exchanger which is used in a water or beverage distribution unit.

U.S. Pat. No. Des. 228,684; DRINKING WATER DISPENSER; L. M. Cannon et al. This patent is directed to the design of a drinking water dispenser cabinet.

U.S. Pat. No. Des. 228,685; ELECTRICALLY-ACTUATED DRINKING WATER DISPENSER; R. J. Radcliffe. This patent is directed to the design of a drinking water cabinet dispenser.

U.S. Pat. No. Des. 235,388; COMBINED BEVERAGE COOLER AND DISPENSER; W. Taylor. This patent is directed to the design of a beverage cooler and dispenser cabinet.

SUMMARY OF THE INSTANT INVENTION

This invention is directed to a relatively simple, inexpensive, lightweight but durable cabinet or stand especially useful with bottled water or similar beverage dispensers. The cabinet is relatively easy to fabricate, assemble and maintain.

The invention includes a cabinet having four substantially similar sides arranged in a rectilinear configuration. Each of the sides has a pair of edges which extend therefrom at an angle. The edges are joined together to form the stand. In one embodiment, a U-shaped clip (or molding strip) slips over the abutted edges of a pair of sides and is arranged to maintain the edges in contact. Each of the clips and edges forms a corner of the cabinet. A stepped base is included in the cabinet with an internal mounting portion to add rigidity an stability. A central support member is also placed in the cabinet intermediate the ends thereof. The support member may take the form of a shelf, if so desired. A top member is arranged to fit over the corners of the cabinet and to interlock therewith. The top member includes reinforcement members to add additional strength thereto so that the top can support the weight of a filled water bottle or the like. An aperture with a collar therearound is provided in the top member to receive a water bottle in the conventional manner.

In addition, provision is made for a faucet or tap to be mounted in at least one side of the cabinet. In addition, a clip or hanger member is provided in the same side to support a drainage receptacle under the faucet noted above.

All of these components are fabricated of a lightweight material such as, but not limited to, polyurethane ABS plastic which is lightweight and relatively inexpensive. The material includes a solid color therethrough wherein scratches or nicks are not noticeable. The parts can be vacuum formed, injection molded or the like. The cabinet parts can be joined together by a suitable adhesive such as glue, sonic welding, laser welding or the like.

DESCRIPTION OF THE PREFERRED EMBODIMENT

Figure 1:
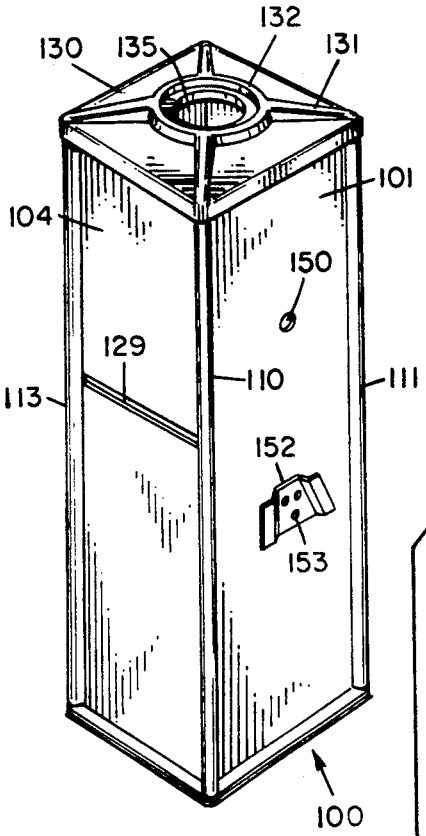
FIG. 1 is an isometric view of a cabinet formed in accordance with the instant invention.

Referring now to FIG. 1, there is shown an isometric view of a cabinet 100 in accordance with the instant invention. In this embodiment, a cabinet is provided which is referred to as a floor-model. In that case, the cabinet is adapted to be free standing on the floor or other similar surface. In addition, the cabinet is substantially fully enclosed.

In this instance, the cabinet includes a plurality of sides. Sides 101 and 104 are shown in this view. In addition, the sides are joined together at the corners thereof. In the preferred embodiment, the corners are joined together by U-shaped molding strips 110, 111 and 113. As shown, the molding strips extend the full length of the cabinet and provide additional strength and rigidity to the cabinet. In addition, at least two opposing sides include an indented groove or channel therein. The grooves 129 are formed in the side and extend inwardly relative to the cabinet. Typically, the grooves 129 are formed at approximately the midpoint of the vertical dimension of the sides. The grooves thus form support channels within the cabinet which can support a shelf, ledge or water reservoir in the cabinet.

A base 120 is provided at the bottom of the cabinet 100. In FIG. 1, the base 120 is shown only as a flange-like element which extends outwardly from the side walls and between the corner moldings.

A top 130 is arranged to rest on the upper edges of the sides and, if utilized, the corner moldings. In the preferred embodiment, the top 130 is not permanently fastened to the sidewalls. This arrangement facilitates the insertion of the water reservoir as well as cleaning of the interior of the unit. However, the top 130 tends to overhang the respective side wall.

Centrally located in top 130 is an opening 135 which passes therethrough. A ring or collar 132 surrounds opening 135 and extends upwardly from the top surface of the top 130. The ring 132 is configured in shape, height and other structure so as to receive the neck of a conventional water bottle. A plurality of wedge-shaped struts 131 extend outwardly from the collar 132 to the corners of the top 130. The struts 131 can be formed integrally with collar 132 and the top 130. This unitary construction provides an additional strengthening for the top 130. The ends of the struts 131 also are arranged to, effectively, rest on the corners and/or corner molding (or beading) of the cabinet 100.

At least one side of the cabinet 100 includes at least one aperture 150 therethrough. Aperture 150 passes through the side 101, in this embodiment. The aperture 150 is adapted to receive the tap or faucet for a water retaining receptacle to be mounted in the cabinet. For convenience, the tap or faucet is omitted in FIG. 1.

A suitable bracket 152 is mounted to the cabinet side 101 by means of appropriate screws 153 or other similar fastening device. The bracket 152 is arranged to have a tapered configuration with flanges extending therefrom. The bracket 152 is, generally, conventional and is adapted to receive and mount a drainage receptacle on the cabinet. The drainage receptacle (not shown) is to be mounted under the faucet or tap in a conventional manner. The drainage receptacle is omitted for convenience in this Figure.

Figure 2:
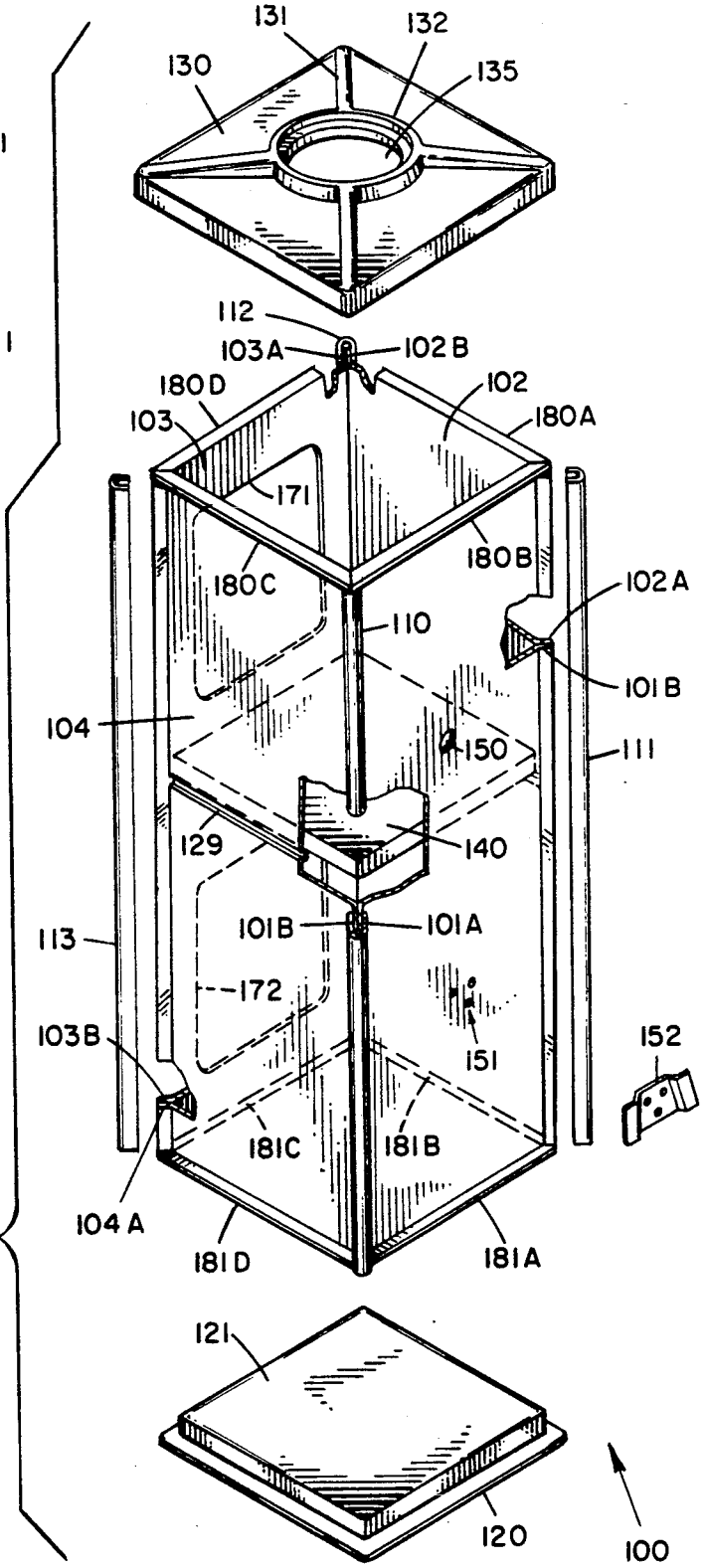
FIG. 2 is an exploded view of the cabinet shown in FIG. 1.

Referring now to FIG. 2, there is shown an exploded view of the cabinet 100 shown in FIG. 1. In this embodiment, similar components bear similar reference numbers.

Thus, the cabinet includes four side walls 101, 102, 103 and 104. These side walls are substantially identical in size and configuration. In addition, each side wall includes the angled corners thereof. For example, side wall 101 includes the angled corners 101A and 101B. Side wall 102 includes the angled corners 102A and 102B. In similar fashion, side walls 103 and 104 include the angled corners 103A and 103B as well as 104A and 104B, respectively.

In one embodiment, the corner moldings or beadings 110, 111, 112 and 113 are adapted to be mounted on the angled corner members which are placed adjacent to each other when the side walls are assembled. For example, the beading 110 is adapted to slide over and engage the panel corners 101A and 104B. In similar fashion, the beading 111 (shown removed for convenience) is adapted to slide over and engage the angled corners 101B and 102A.

The corner beadings 110, 111, 112 and 113 are arranged to fit snugly over the respective angled corners and to maintain the corners in close abutment to each other. Typically, the beadings are U-shaped components which have a slight bias toward the closed position. Thus, the beadings tend to clamp the side wall edges together under some force. As noted above, the beading can be joined to the respective angled corners in any suitable fashion such as be adhesive, laser welding, sonic welding and/or the like.

In this embodiment, the rear wall 103 may include one or more cutout sections 171 and 172. These cutouts provide access to the interior of the cabinet for cleaning and/or the like.

The base 120 is adapted to be mounted to the bottom end of the cabinet as shown in FIG. 1. In addition, the base 120 may preferably include a raised central portion 121 which has the appropriate dimensions to fit the internal dimensions of the cabinet. Thus, the elevated central portion 121 of the base 120 can also be adhered to the bottom edges of the cabinet side walls by means of a suitable adhesive, laser welding, sonic welding, fasteners or the like. This construction will provide additional strength and rigidity to the cabinet 100.

The top 130 is substantially identical to the top 130 shown in FIG. 1. It is seen that the corners of the top are arranged to overlie the corners of the cabinet including the beading strips. The corners and the beading strips then provide additional structural strength to support the top 130. In addition, the top 130, because it overhangs the beading strips, maintains the strips and the associated side walls in proper alignment. Thus, strength and rigidity of the cabinet 100 is enhanced. As noted, the top 130 is not necessarily joined to the sidewalls in a permanent fashion. However, suitable fasteners, such as clips or the like, can be utilized, if desired.

As shown in FIG. 2, an intermediate shelf or brace 140 is provided. The shelf 140 may be a relatively simple rectilinear unit which is arranged to have the outer dimensions substantially equal to the internal dimensions of the cabinet 100. The shelf 140 can be mounted, as shown, intermediate the upper and lower ends of the side walls. In particular, the shelf 140 can be arranged to rest on the indented grooves 129 in at least two side walls. By appropriately fastening the shelf to the side walls (for example, using the techniques noted above), the shelf 140 is retained in position. In addition, shelf 140 provides further strengthening and rigidity to the cabinet 100. Of course, additional shelves or horizontal struts can be mounted in the cabinet 100. Likewise, other vertical or crossbar support struts can be used, as well, to add rigidity to the cabinet; to support the shelf 140; or the like.

Shelf 140 should, however, be sufficiently strong in itself and in its connection to the side walls of cabinet 100 in order to support a water receptacle such as a holding tank or an olla thereon. The water receptacle (not shown) is placed on the shelf 140 in the cabinet 100 within the side walls so as to receive the water from the water bottle (not shown) when it is mounted on the cabinet through the hole 135 in the top 130.

When the water receptacle is in place, a tap (not shown) can be inserted through opening 150 in the front side wall of the cabinet 100. The tap will then provide the means for dispensing water from the receptacle or holding tank or olla in the cabinet.

The bracket 152 is shown displaced from the side wall 101. However, a pattern of holes 151 is shown in the side wall. These holes are provided to receive the screws, rivets, bolts or the like which are used to mount the bracket 152 to the front surface of the cabinet 100.

As noted above, all of these components of the cabinet 100 (with the possible exception of bracket 152 and the fasteners related thereto) can be formed of a suitable plastic material. Each of the parts can be produced through a suitable vacuum forming process or any other appropriate technique. The preferred material for fabricating the parts is polyurethane ABS plastic which is arranged to have a solid color therethrough to avoid nicking and scratching. Of course, other suitable materials can be used in fabricating the cabinet of this invention. Likewise, the specific designs or the specific methods for joining the components can vary somewhat, as well, without departing from the thrust of this invention.

Thus, there is shown and described a unique design and concept of a water bottle dispenser stand. The particular configuration shown and described herein relates to a floor model. However, other designs are contemplated. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. A water dispenser cabinet comprising, a plurality of side panels, said side panels are of substantially similar size and configuration, said side panels are formed of a sheet of a plastic-type material, each of said side panels having edges extending therefrom for joining said side panels together, said side panels are vacuum formed to the prescribed configuration, a base member for supporting said side panels, and a top member for overlying the upper ends of said side panels, said top member includes an aperture therethrough for receiving at least a portion of a container of liquids, said top member includes strengthening portions therein adjacent to said aperture.

2. The cabinet recited in claim 1 including, a plurality of beading members for engaging and securing the edges extending from a pair of adjacent side panels.

3. The cabinet recited in claim 1 wherein, said plastic-type material is relatively strong and lightweight.

4. The cabinet recited in claim 3 wherein, said plastic-type material is polyurethane.

5. The cabinet recited in claim 1 including, support means mounted at the inner surface of one or more of said side panels.

6. The cabinet recited in claim 5 wherein, said side panels include indented grooves for mounting said support means to said side panels.

7. The cabinet recited, in claim 5 wherein, said support means comprises a shelf for receiving a receptacle adapted for holding liquids therein.

8. The cabinet recited in claim 1 wherein, said edges extend outwardly at an angle from said side panels.

9. The cabinet recited in claim 8 wherein, said edges of adjacent side panels are disposed in side-by-side engagement.

10. The cabinet recited in claim 9 including, at least one clamping member for engaging and securing said edges in said side-by-side engagement.

11. The cabinet recited in claim 10 wherein, said clamping member comprises a generally U-shaped resilient member which is biased to substantially close the open end of said U-shaped resilient member thereby to engage said edges.

* * * * *